US005495721A

United States Patent [19]

Stueble

[11] Patent Number: 5,495,721

[45] Date of Patent: Mar. 5, 1996

[54] PROCESS FOR COOLING AND CONDITIONING AIR

[75] Inventor: Helmut Stueble, Spartanburg, S.C.

[73] Assignee: LTG Lufttechnishche GmbH, Stuttgart, Germany

[21] Appl. No.: 283,026

[22] Filed: Jul. 29, 1994

[30] Foreign Application Priority Data

Jun. 3, 1994 [DE] Germany ..... 44 19 441.2

[51] Int. Cl.[6] ..... F25D 17/02

[52] U.S. Cl. ..... 62/121; 62/91; 62/238.1

[58] Field of Search ..... 62/91, 121, 238.1, 62/259.4, 406; 57/406

[56] References Cited

U.S. PATENT DOCUMENTS

| | | | |
|---|---|---|---|
| Re. 20,944 | 12/1938 | Baker . | |
| 1,075,197 | 10/1913 | Cramer et al. . | |
| 1,861,158 | 5/1932 | Hilger . | |
| 2,044,352 | 8/1936 | Evans . | |
| 2,104,851 | 1/1938 | Crawford | 62/91 |
| 2,187,905 | 1/1940 | Killingsworth . | |
| 2,235,005 | 3/1941 | Ashley . | |
| 2,254,185 | 8/1941 | Newton . | |
| 3,807,157 | 4/1974 | Stahlecker | 57/406 |
| 4,112,663 | 9/1978 | Chrtek et al. | 57/406 |
| 4,540,118 | 9/1985 | Lortie et al. . | |
| 4,552,303 | 11/1985 | Fisher et al. . | |
| 4,761,965 | 8/1988 | Viner | 62/171 |
| 4,857,090 | 8/1989 | Hartness | 62/91 |
| 4,909,976 | 3/1990 | Cuculo et al. | 264/211.15 |
| 4,988,270 | 1/1991 | Stibal et al. | 425/72.2 |

OTHER PUBLICATIONS

Roof Cooling System Lowers Energy Costs, Food Processing, Aug., 1987, Robert J. Swientek.

*Primary Examiner*—Henry A. Bennett
*Assistant Examiner*—William C. Doerrler
*Attorney, Agent, or Firm*—Dority & Manning

[57] ABSTRACT

The invention relates to a process for the cooling and conditioning of air heated in a process, in particular of machine exhaust air which is cooled through heat exchange by means of a cooling medium, whereby water is preferably used as the cooling medium. It is provided that open waters, well and/or tap water of the water supply network are used for the heat exchange, whereby this water is used after utilization in the heat exchange at other locations for the cooling of the process and/or as hot water for further utilization in the process.

18 Claims, 1 Drawing Sheet

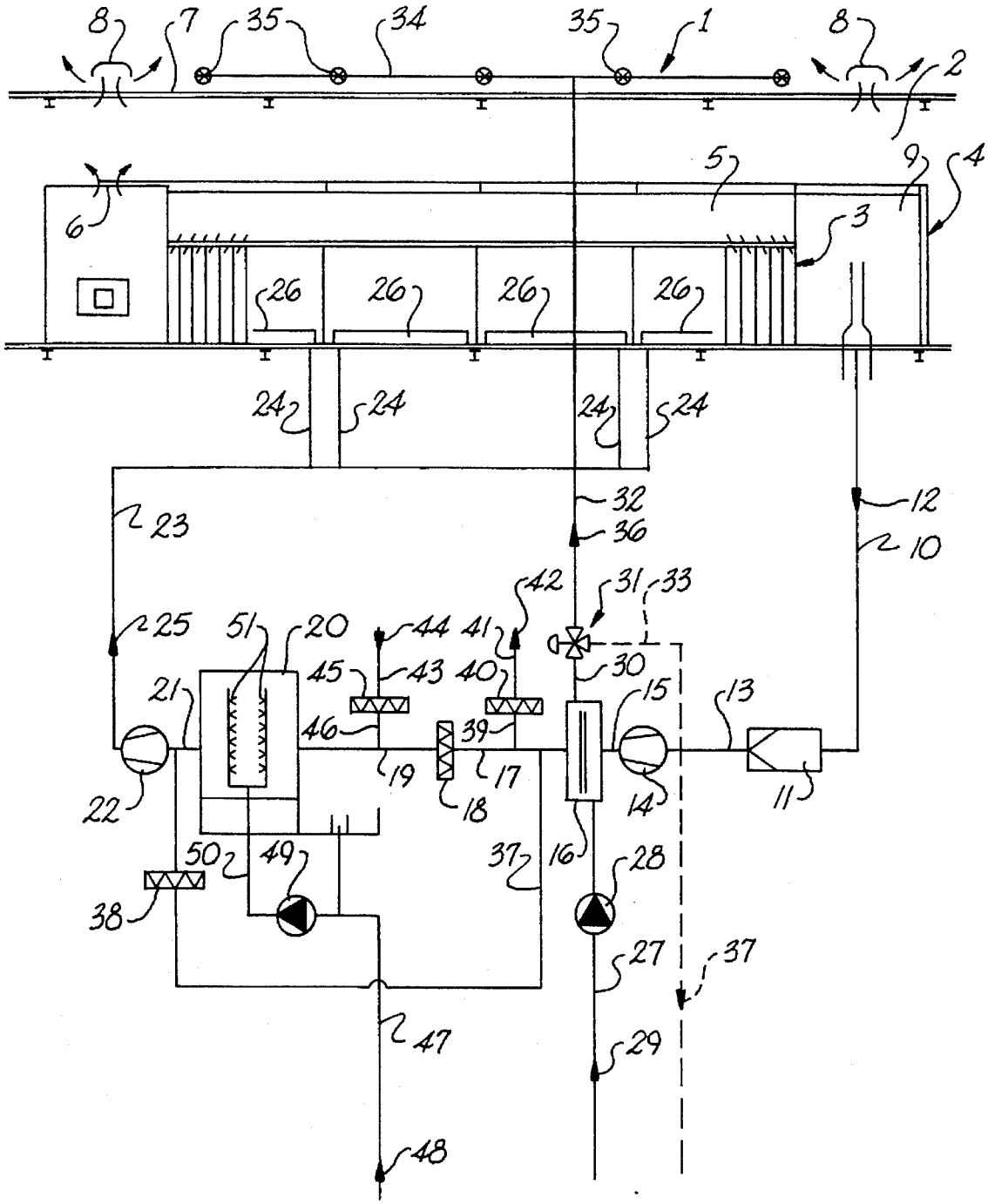
8
7
35
34
35
1
8
2
5
9
4
6
3
26
26
26
26
24
24
24
24
23
32
36
12
10
25
51
20
44
41
42
31
33
45
43
40
30
21
46
39
15
13
19
17
18
14
11
22
50
49
37
16
28
38
27
37
47
29
48

PROCESS FOR COOLING AND CONDITIONING AIR

BACKGROUND OF THE INVENTION

The invention relates to a process to cool/condition air heated in a process, in particular machine exhaust air which is cooled through heat exchange by means of a cooling medium, whereby a fluid medium is used as the cooling medium.

A number of machines, e.g. textile machines, in particular open-end spinning machines, release process air at high temperature. A large open-end spinning machine with approximately 290 rotors has an installed capacity of approximately 75 kW. Added to this capacity is an illumination capacity of approximately 4 kW in the machine room (spinning room) and a roof load of approximately 6 kW, (in particular sunlight irradiation) depending on the time of the year and the geographic location. From all of this it appears clearly that a very great amount of exhaust heat is produced by each machine. In order to maintain temperature and humidity conditions in the spinning room that are required for smooth yarn production, approximately 85 kW output per machine is fed to the air conditioning plant which cools and conditions the air at a high energy expenditure. The hot process air leaves the process at a temperature of approximately 50° C., i.e. 25° C. above room temperature. In many geographic locations with hot climate, it has been shown that cooling of the hot process air to a lower temperature, i.e. to a lower enthalpy value, is more energy-efficient than to exterior air.

The cooling of process air by means of cooling water flowing through a cooling coil and coming from a cooling tower which is part of the circuit is known, for example, from U.S. Pat. No. 4,857,090. The cooling water which is heated during the cooling process is returned to the cooling tower, is cooled there to a lower temperature and is then again available to cool the hot process air. This known process needs improvement from the point of view of energy efficiency.

OBJECTS AND SUMMARY OF THE INVENTION

It is therefore a principal object of the invention to create a process of the type mentioned for cooling heated process air, by which energy and costs are saved. It is therefore an energy-saving concept for cooling and conditioning air heated in a process which is provided by the present invention. Additional objects and advantages of the invention will be set forth in part in the following description, or will be obvious from the description, or will be learned through practice of the invention.

The objects are attained through the invention in that the fluid medium used for the heat exchange, in particular water, is used following its use in the heat exchange at another location to cool the conduct of the process and/or as a heating medium, in particular hot water, for further utilization in the conduct of the process.

Open waters, water from wells and/or tap water of the water supply network are preferably used. "Open waters" are understood to be river water, source water, lake water, water from artificial lakes etc., and also water emerging at the earth surface. "Well water" is understood to be any kind of water occurring underground. The tap water which is also mentioned comes from the water supply, e.g. the municipal water supply; it is therefore made available by the municipal water works or similar installations. In the sense of the invention, artificial water feeds, e.g. from an artificial lake or from a circuit are also counted as open waters. In the sense of the invention, tap water also includes water coming from a technical circuit, or is produced in a technical process for further utilization. Due to the fact that the water used for heat exchange subsequently continues to be available at another location for the conduct of the process in that it is used to cool the conduct of the process or is used as hot water for other uses in the conduct of the process, an optimal energy balance is achieved. The water heated in the heat exchange is suitable, in spite of the acquired heat, to favorably influence the temperature prevailing in the conduct of the process, e.g. by being used to lower the roof load, i.e. to cool the room in which the heated process air is produced. On the other hand, and in addition, it is also possible to further heat the hot water made available by the heat exchange in order to use it in the form of process steam. Since it has already reached a certain temperature due to the heat exchange process, the amount of energy needed to produce the process steam is proportionately less than for water at lower temperature.

As has been mentioned, it is thus possible to apply the water used for heat exchange to cool the room in which the process is carried out. The water used for the heat exchange is used in particular as a roof coolant on the building in which the room is located. This causes the overall load to be reduced. In particular, sprinkling of the heated water on the roof of the building is carried out, making possible to obtain cooling to approx. 30° C., even in hot regions. The sprinkled water is not recycled, i.e. it evaporates on the roof.

In a preferred embodiment of the invention, provisions are made for the air cooled by the heat exchange to be recycled in the process. This is done in particular in that it is conditioned by spraying before being again fed to the process, and is preferably cooled further.

It is in particularly advantageous for outside air to be admixed to the air which is subjected to spray humidification. But, this is only done if it makes sense in light of the state of the outside air (temperature, relative humidity). It is thereby possible to influence the conditioning and temperature of the air coming from the process.

In hot regions, spray humidification is preferably effected with cooled water.

In a preferred embodiment, it is also possible to remove the air heated in the process at least partially to the outside as waste air. This makes sense if it is of greater advantage to use outside air than air coming from the process.

In another embodiment, at least part of the air cooled by the heat exchange is fed to a bypass to avoid the spray humidification. This makes it possible to achieve control/regulation for the conditioning of the air fed back into the process. If the air leaves the spray process with too little relative humidity for example, and/or with too low a temperature, the addition of air coming from the heat exchange process by way of the bypass can be used to make the necessary correction. Appropriate control valves are provided for this. There furthermore exists of course a possibility of influencing the conditioning by regulating the amount of water fed to the spray humidifier. Furthermore it is also possible to act upon the temperature of the cooling water of the spray humidifier (air washer).

It is especially advantageous for the machine exhaust air to come from textile machines, in particular open-end spinning machines, since the process according to the invention makes it possible to achieve great savings with such textile machines.

The air of the textile machine(s), in particular of the open-end textile machine, which is newly fed from below to the process, is preferably fed in such a manner that the air takes effect between the rovings of the cans below the textile machine containing the textile material and is then aspired at least partially by the rotors of the textile machine. By bringing the air into the area of the cans, the rovings are conditioned appropriately, i.e. the material, e.g. cotton, has the correct temperature and humidity to be processed optimally. The cooled/conditioned air is then aspired at least partially by the rotors of the textile machine and is thus available to the textile machine as cooling air.

In another embodiment of the invention, the air being fed to the heat exchange is only part of the total air mass used to conduct the process, in particular only part of the entire air mass fed to the textile machine, and the remainder of the air is conveyed to the outside. The diversion to the outside is preferably effected by means of exhaust air openings such as exhausters, in particular roof exhausters. Alternatively or in addition, it is also possible for air to be sucked to the outside.

The drawing explains the invention through the example of an embodiment thereof.

BRIEF DESCRIPTION OF THE DRAWINGS

FIG. 1 is a partial schematic and diagrammatic view of a preferred embodiment of the invention.

DETAILED DESCRIPTION OF THE PREFERRED EMBODIMENT

Reference will now be made in detail to the present preferred embodiment of the invention, an example of which is illustrated in the drawings. Each example is provided by way of explanation of the invention, and not as a limitation of the invention. In fact, it will be apparent to those skilled in the art that various modifications and variations can be made in the invention without departing from the scope or spirit of the invention.

The figure shows schematically a section of a building 1 with a room (spinning room) in which several open-end spinning machines 3 are set up. For the sake of simplification, only one open-end spinning machine 3 is drawn in the figure.

The open-end spinning machine 3 is surrounded by a housing 4 so that a space 5 is formed above the machine, in which the air heated by the spinning process accumulates and is then, for the major part, expelled through an outlet 6 of the housing 4, rising in space 2 to the roof 7 of the building 1 and emerging there to the exterior through roof exhausters 8. The remaining portion of the heated machine exhaust air goes via space 5 into a chamber 9 of housing 4 and from there, through a channel 10, to a filter 11. The direction of flow in the channel is indicated by an arrow 12. The filter 11 is connected via a channel 13 to a ventilator 14 which aspires the air coming from chamber 9 and conveys it through a channel 15 to a heat exchanger 16. The air leaving the heat exchanger 16 goes through a channel 17 to an air throttle 18 and from their through a channel 19 to an air humidifier 20 (air washer). On the outlet side, the air humidifier 20 is connected via a channel 21 to a ventilator 22, the outlet of which leads back via a channel 23 which is provided with branches 24 to the open-end spinning machine 3. The direction of flow in the channel 23 is indicated by arrow 25. The branches 24 lead to air outlets 26 which convey the air from below to the open-end spinning machine 3 in such a manner that it influences the rovings of the cans which are below the open-end spinning machine 3 and contain the textile material and is then aspired at least in part by the rotors of the open-end spinning machine 3 which are not shown.

A liquid conduit 27 leads to the heat exchanger 16, whereby the cooling fluid is conveyed by means of a pump 28 or through the pressure of the cooling fluid system itself in the direction of arrow 29. The water fed through the cooling water conduit 27 fills one or several coils or cooling spiral in the heat exchanger 16 and leaves the latter through a conduit 30 leading to a three-way valve 31. The other two paths of the three-way valve 31 are connected to a conduit 32 or to a conduit 33. Conduit 32 leads to a conduit system 34 which is installed outside on the roof 7 of the building 1 and is equipped with water spraying nozzles 35, in case that the cooling fluid is water. The direction of flow of the water in the conduit 32 is indicated by an arrow 36. The conduit 33 is traversed in the direction of arrow 37 and leads (in a manner not shown) directly, or with intercalation of additional technical equipment, to the open-end spinning machine 3. A bypass 37' branches off from channel 17 and leads to channel 21, i.e. it bridges the air humidifier 20, and is equipped with an air throttle 38. A channel 39 is connected to channel 17 and leads to an air throttle 40 from which a channel 41 goes to the outside. The direction of flow in the channel 41 is indicated by an arrow 42. In addition, a channel 43 is provided, which is connected to the outside air and is traversed in the direction of arrow 44, said channel leading to an air throttle 45 which is connected via a channel 46 to channel 19.

Conditioned cooling water coming from a device not shown here flows through a conduit 47 in the direction of an arrow 48 and reaches a pump 49 and from there, via a conduit 50, the spray nozzles 51 of the air humidifier 20.

The water fed to the heat exchanger 16 via cooling water conduit 27 is taken from open waters, wells and/or the municipal water supply network (tap water).

The system functions as follows: It is assumed for illustration purposes that the open-end spinning machine 3 has an installed capacity of 75 kW, that the illumination of the room 2 which is associated with the open-end spinning machine 3 has a capacity of 4 kW and that the appertaining roof load due to sunlight irradiation etc. comes to 6 kW. For each spinning machine an air mass of approximately 5,270 $m^3/h$ at a temperature of 50° C. is taken via a channel 10 and, conveyed by ventilator 14, is fed via filter 11 to the heat exchanger 16. In the embodiment under consideration, the heat exchanger 16 is supplied e.g. with tap water of the water supply network (conveyed by pump 28) which fills the cooling coils and has a temperature in the range of 10° to 22° C., depending on the time of year and the geographic conditions. It is assumed for illustration purposes that the cooling water temperature is 18° C. After cooling the air going through the heat exchanger 16 this water leaves the heat exchanger 16 at a correspondingly higher temperature and reaches the three-way valve via conduit 30. Depending on the position of the three-way valve, it is then directed through conduit 32 to the roof 7 of building 1, where it is distributed by water spraying nozzles 35 outside on the roof 7 and thus cools roof 7 and thereby also room 2 of building 1 in which the open-end spinning machine 3 is located. In this manner it is possible to cool the roof 7, for instance, to a temperature of 30° C. (in summer, under clear skies). The water is not fed back but evaporates completely on the roof 7.

If the three-way valve 31 is in its other position, the water coming from the heat exchanger 16 is used by means of the conduit 33 as hot water for further utilization in the process of the open-end spinning machine 3, e.g. in that hot steam needed for the operation of the spinning machine is produced from this water and/or in that the heated water is used for sizing. It is of course also possible for part of the water to be used to cool the roof and the remaining water to be used in the process as hot water. Both portions serve however to assist the spinning process in that cooling of the process and/or heat supply for the process takes place.

The air leaving the heat exchanger 16 is cooled to a temperature of approximately 23° C. to 30° C. depending on side constraints, and goes through channel 17 and an air throttle 18 to the air humidifier 20. Conditioning (humidification and further cooling) takes place there by means of the cooling water which is sprayed by the spray nozzles 51. The ventilator 22 conveys the appropriately cooled air through channel 23 and via embranchments 24 to the open-end spinning machine 3. The arriving air mass amounts preferably to 9,350 $m^3/h$ per spinning machine. The air mass difference between the air mass in channel 23 and in channel 10 is compensated for by feeding outside air through channel 43 and by setting the air throttle 45 accordingly.

The supply of air mass amounts to 4,080 to 9,350 $m^3/h$ per machine, depending on the condition of the outside air (humidity and temperature). The latter quantity applies if the temperature of the outside air is lower than the air in channel 17. In that case the air throttle 40 is opened and the air which is in channel 17 leaves the system via conduit 41 towards the outside in the form of waste air at a rate of 0 to 5,270 $m^3/h$ per machine.

In addition or alternatively to the supply of outside air, it is also possible, depending on the condition of the air, to feed air from space 2, preferably from near the room ceiling, via channel 43 to the air humidifier 20. The waste air near the room ceiling has a temperature of approximately 40° to 45° C.

In an embodiment of the invention which is not shown here it is also possible not to divert the waste air downstream of the air humidifier 20, but to connect channel 39 to channel 15 and not to channel 17, for instance.

Through regulation of the air throttles 18 and 38 it is possible to act upon the operating control of the air humidifier 20. Added to this is a possibility of adjusting the quantity of cooling water fed to the air humidifier 20 as well as its temperature. In this manner air can be conditioned in channel 21 to the desired temperature as well as to the desired relative humidity.

The heat exchanger 16 is preferably a gilled-pipe heat exchanger ($H_2O$/air).

The air throttle 18 allows the passage of an air mass from 0 to 5,270 $m^3/h$ per machine, depending on the arrangement of the operation. The bypass is controlled by means of the air throttle 38 so that it carries an air mass from 0 to 2,550 $m^3/h$ per machine.

The air conditioning of the open-end spinning machine 3 is effected, as mentioned earlier, from below, whereby the relative humidity is preferably 55 to 65%. Thus over-humidification of the rovings of the spinning material is prevented. Concerning the air mass to be used, it suffices to use only approximately half of the air mass needed in the conventional process on a machine with 288 spindles.

The utilization of open water, well water and/or tap water can be applied alternatively or in a combination of different types of water, depending on the time of year. Thanks to the cooling of the building roof, the roof load is compensated for, or even overcompensated, i.e. a negative roof load results. Due to the fact that the water on the roof evaporates completely, no waste water costs are incurred. The required cooling capacity of the energy-saving plan for the conduct of the process, according to the invention, in particular for open-end spinning machines, is only approximately 30% of a conventional system. The energy consumption of the ventilators for return air and air supply are reduced to approximately 50%. Energy costs for an open-end spinning machine, taking into account air-conditioning/filtering, comes to only about 35% of that for a conventional installation. Also the investment costs, at approximately 70%, are by far preferable to a conventional system.

It will be apparent to those skilled in the art that various modifications and variations can be made in the present invention. For example, features of one described embodiment can be added to another embodiment to yield a still further embodiment. It is intended that the present invention cover such modifications and variations as come within the scope of the appended claims and their equivalents.

I claim:

1. A method for cooling and conditioning heated waste air generated in a textile room from textile machines carrying out a textile process, said process comprising:

drawing the heated waste air from the textile room and passing the air through a liquid medium heat exchanger;

drawing a liquid cooling medium at a desired temperature from a constant source and passing the liquid cooling medium through the heat exchanger to cool the heated waste air, the liquid cooling medium thereby being heated by the heated waste air;

recycling at least a portion of the cooled air exiting the heat exchanger back to the textile room; and directing the heated liquid cooling medium from the heat exchanger to an operative location in the textile process requiring a separate medium of approximately the temperature of the heated liquid cooling medium, and using the heated liquid cooling medium at the location as a source of the separate medium to reduce the overall energy consumption of the textile process.

2. The method as in claim 1, further comprising directing the heated liquid cooling medium from the heat exchanger to a location in the textile process requiring a relatively heated medium for carrying out the textile process.

3. The method as in claim 2, further comprising using the heated liquid cooling medium in a hot water-steam production process in the textile process.

4. The method as in claim 1, further comprising directing the heated liquid cooling medium from the heat exchanger to a location in the textile process for cooling the textile room, and using the heated liquid cooling medium to separately cool the air in the textile room thereby reducing the load on the heat exchanger.

5. The method as in claim 4, further comprising directing the heated liquid cooling medium from the heat exchanger to the roof of the textile room for spraying onto the roof to cool the textile room.

6. The method as in claim 5, further comprising allowing the liquid cooling medium sprayed onto the roof to evaporate.

7. The method as in claim 1, further comprising drawing the liquid cooling medium from any one of an open water source, a well, and a water supply network.

8. The method as in claim 1, further comprising further conditioning the cooled air exiting the heat exchanger by passing the air through a spray humidification process to cool and humidify the air prior to recycling the cooled air to the textile room.

9. The method as in claim 8, further comprising bypassing at least a portion of the cooled air exiting the heat exchanger around the spray humidification process.

10. The method as in claim 8, further comprising admixing additional air to the cooled air after the spray humidification process and directing the admixed air to the textile room.

11. The method as in claim 10, further comprising admixing outside air with the cooled air.

12. The method as in claim 10, further comprising admixing air from the textile room with the cooled air.

13. The method as in claim 1, further comprising directly exhausting at least a portion of the heated waste air from the textile room to the outside so that the air supplied to the heat exchanger is only a part of the overall air mass returned to the textile room.

14. The method as in claim 1, wherein said method is used to cool and condition heated waste air from open-end spinning machines.

15. The method as in claim 14, further comprising directing the cooled air to the open-end spinning machines from below in the area of textile cans located below the open-end spinning machine containing fiber sliver to be processed, the cooled air thereby conditioning the fiber sliver prior to processing by the open-end spinning machine, and aspiring at least a portion of the cooled air by spinning rotors of the open-end spinning machine.

16. A method for cooling and conditioning air in a textile room having any number of textile machines generating heated waste air, said method comprising:

directly exhausting at least a portion of the heated waste air directly to the outside and drawing at least another portion of the heated waste air through a liquid cooling medium heat exchanger;

drawing a liquid cooling medium at a desired temperature from a constant source and passing the liquid cooling medium through the heat exchanger to cool the heated waste air, the liquid cooling medium thereby being heated by the heated waste air;

passing at least a portion of the cooled air exiting the heat exchanger through a spray humidification device to further cool and humidify the air;

admixing air from another source with the cooled air exiting the spray humidification device and returning the admixed air to the textile room;

directing the heated liquid cooling medium to the roof of the textile room; and spaying down the roof of the textile room with the heated liquid cooling medium to cool the air in the textile room below thereby reducing the load on the heat exchanger and spray humidification device.

17. The method as in claim 16, further comprising controllably bypassing a portion of the cooled air from the heat exchanger around the spray humidification device to achieve a desired temperature and relative humidity of the air being returned to the textile room.

18. The method as in claim 16, further comprising directing the cooled air into the textile room generally in the area of sliver cans below open-end spinning machines to condition the fiber sliver in the cans.

* * * * *